US011162411B2

(12) United States Patent
Kurowski et al.

(10) Patent No.: US 11,162,411 B2
(45) Date of Patent: Nov. 2, 2021

(54) HEAT EXCHANGER FOR MOTOR VEHICLE

(71) Applicant: Valeo Autosystemy Sp. z o.o., Skawina (PL)

(72) Inventors: Boleslaw Kurowski, Skawina (PL); Maciej Klusek, Skawina (PL); Robert Bieniek, Skawina (PL); Radoslaw Jonczyk, Skawina (PL)

(73) Assignee: Valeo Autosystemy Sp. z o.o., Skawina (PL)

( * ) Notice: Subject to any disclaimer, the term of this patent is extended or adjusted under 35 U.S.C. 154(b) by 212 days.

(21) Appl. No.: 16/605,097

(22) PCT Filed: Mar. 30, 2018

(86) PCT No.: PCT/EP2018/058339
§ 371 (c)(1),
(2) Date: Oct. 14, 2019

(87) PCT Pub. No.: WO2018/188979
PCT Pub. Date: Oct. 18, 2018

(65) Prior Publication Data

US 2021/0131339 A1 May 6, 2021

(30) Foreign Application Priority Data

Apr. 14, 2017 (EP) ..... 17461522

(51) Int. Cl.
*F28F 9/02* (2006.01)
*F02B 29/04* (2006.01)
(Continued)

(52) U.S. Cl.
CPC ..... *F02B 29/0462* (2013.01); *F28D 7/1684* (2013.01); *F28D 2021/0082* (2013.01);
(Continued)

(58) Field of Classification Search
CPC ..... F02B 29/0462; F28D 7/1684; F28D 2021/0082; F28F 9/001; F28F 9/0219; F28F 2265/16
(Continued)

(56) References Cited

U.S. PATENT DOCUMENTS

2003/0196785 A1* 10/2003 Knecht ..... F28D 7/1684 165/148
2010/0206532 A1* 8/2010 Alahyari ..... F28F 9/028 165/173
2010/0206534 A1* 8/2010 Amaya ..... F28D 7/1692 165/173

FOREIGN PATENT DOCUMENTS

CN 101184972 A 5/2008
CN 101568790 A 10/2009
(Continued)

OTHER PUBLICATIONS

International Search Report and Written Opinion issued in corresponding PCT Application No. PCT/EP2018/058339, dated Jun. 1, 2018 (8 Pages).
(Continued)

*Primary Examiner* — Davis D Hwu
(74) *Attorney, Agent, or Firm* — Osha Bergman Watanabe & Burton LLP

(57) ABSTRACT

The invention relates to a heat exchanger for motor vehicles, comprising: a core (2) comprising a tube bundle of open ends stacked tubes (3) and comprising a top and a bottom extreme tubes (3*a*,3*b*); headers (4,5), each having a shaped flange (4*a*,5*a*) with corners (4*b*,5*b*) and being connected with open ends of the tubes (3,3*a*,3*b*); and side housing parts (6, 7) situated on opposite sides of the core (2) and extending at least partly between the extreme tubes (3*a*,3*b*) and between the header (4,5). At least one of the side housing parts (6,7) have at least one protrusion (10) projecting from
(Continued)

the side housing part (6,7) in a corner thereof and bent to contact the side surface of the tube bundle; the at least one protrusion (10) has an external surface (10') opposite to the tube bundle and formed into a shape matching the profile shape of the flange (4*a*,5*a*) of the header (4,5) in its corner (4*b*,5*b*); wherein the said external surface (10') of the at least one protrusion (10) abuts the flange (4*a*,5*a*) of the said header (4,5) to ensure a liquid-tight connection of the header (4, 5) with the flange (4*a*, 5*a*) at the corner (4*b*,5*b*) thereof.

17 Claims, 4 Drawing Sheets

(51) Int. Cl.
*F28D 7/16* (2006.01)
*F28D 21/00* (2006.01)
*F28F 9/00* (2006.01)

(52) U.S. Cl.
CPC ..... *F28F 9/001* (2013.01); *F28F 9/0219* (2013.01); *F28F 2265/16* (2013.01)

(58) Field of Classification Search
USPC ..... 165/173
See application file for complete search history.

(56) References Cited

FOREIGN PATENT DOCUMENTS

| | | | |
|---|---|---|---|
| CN | 102138054 | A | 7/2011 |
| CN | 102762947 | A | 10/2012 |
| CN | 104896990 | A | 9/2015 |
| DE | 102010040983 | A1 | 3/2012 |
| FR | 2980838 | A1 | 4/2013 |
| JP | H04-115280 | U | 10/1992 |
| WO | 2016097135 | A1 | 6/2016 |

OTHER PUBLICATIONS

First Office Action in corresponding Chinese Application No. 201880035450.0, dated Nov. 24, 2020 (13 pages).

* cited by examiner

HEAT EXCHANGER FOR MOTOR VEHICLE

The invention relates to a heat exchanger for motor vehicles.

Heat exchangers used in motor vehicles are designed for cooling air supplied for combustion to the engine, in order to increase engine efficiency. A typical heat exchanger comprises a core consisting of a tube bundle comprising oblate tubes situated parallel to and at a distance from one another and having their open opposite ends attached to headers for supplying and discharging air to individual tubes. The headers are connected with respective inlet and outlet connector pipes. On the sides of the core there are placed side housing parts comprising an inlet and an outlet of cooling liquid, usually water. The side housing parts, together with the extreme core tubes and headers, form a liquid-tight housing wherein the cooling liquid circulates around the gas pipes thus cooling the air passing there through. After assembling the heat exchanger, the surfaces of the extreme tubes and headers and the edges of the side housing parts are typically soldered together in a soldering furnace to ensure cooling liquid leak tightness.

One essential problem in the production of heat exchanger of this kind consists in ensuring tightness of the heat exchanger housing preventing leakages of the circulating liquid, in particular in the corners of header flanges. Various attempts are made to solve this problem, but the results are unsatisfactory.

DE102010040983 discloses a heat exchanger having a core having a tube bundle comprising oblate tubes whose opposite open ends are connected with headers and comprising a housing surrounding the core. In order to improve leak tightness of the cooler after soldering and fixing the position of the housing parts relative to the headers, flat plate protrusions have been used. The protrusions are arranged on the side wall edges of the housing and extend in the plane of the side walls and along the sides of the extreme pipes of the core. Further, cutouts have been used which are made in the headers and are arranged to receive the respective plate protrusions when connecting the side walls with the headers.

The object of the present invention is to provide a heat exchanger which characterized by improved tightness in the corners of header flanges that eliminates leaks of the cooling liquid.

The further object of the present invention is to provide a water charge air cooler which characterized by improved tightness in the corners of header flanges that eliminates leaks of the cooling liquid.

The object of the invention is achieved according to the features of the independent claim 1.

Preferred embodiments can be derived, inter alia, from the dependent claims and the subsequent disclosure.

The use of protrusions in the corners of the side housing parts and their advantageous configuration ensures a leak-tight connection of the pipes and the side parts with headers in the corners of their flanges. Specifically, due to the use of protrusions having greater deformability than the collector material, a leak-tight connection is obtained between the pipe bundle, side housing parts housing and corners of collector flanges, thus avoiding leakages of cooling liquid at the ends of liquid circulation in the heat exchanger. The main advantage of the solution consists in reducing a number of production defects due to liquid leakages in the corners and generally lower costs of production of such type of heat exchanger.

The invention will be explained on the basis of exemplary embodiments presented in the description with reference to the enclosed drawings wherein.

Figure 1:
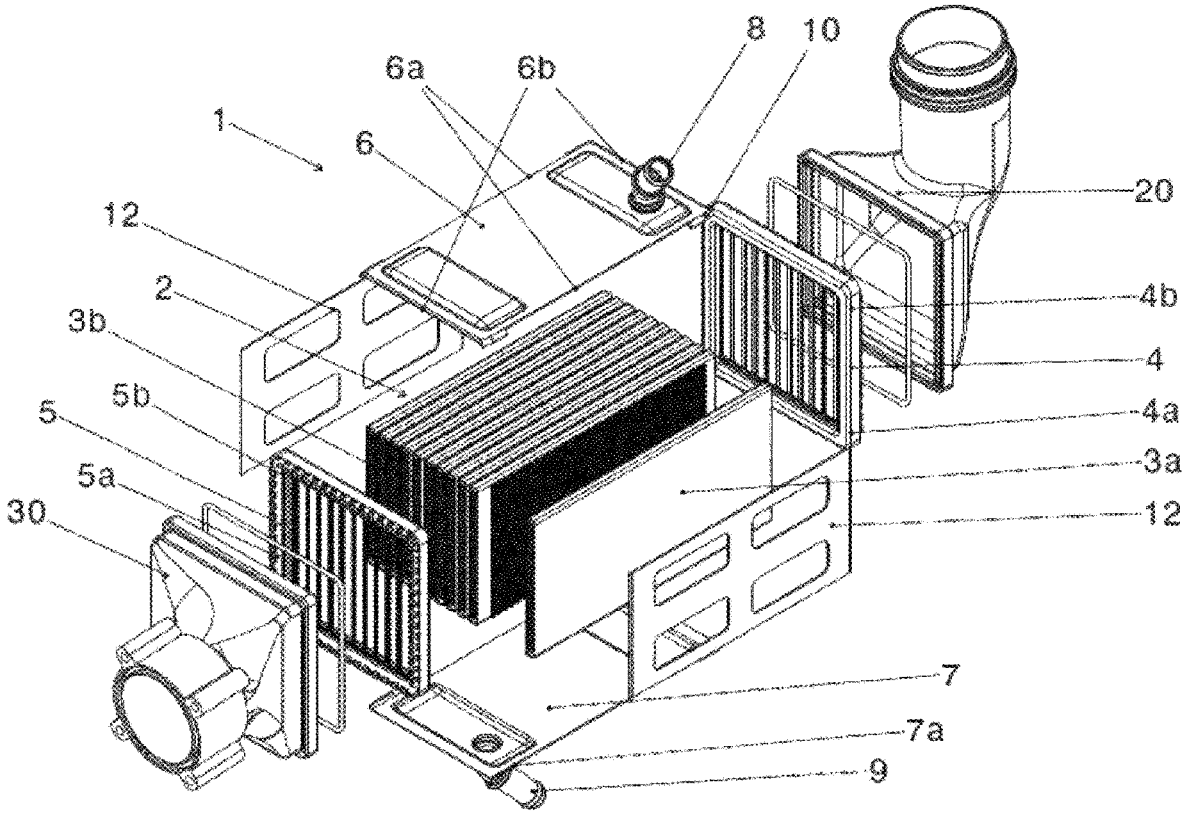
FIG. 1 shows an exploded isometric view of a heat exchanger.

The heat exchanger 1 designed for a motor vehicle as presented in FIG. 1 comprises a core 2 consisting of a tube bundle having a plurality of oblate tubes 3 for conducting gas, in particular air, to be cooled in the heat exchanger 1. The oblate tubes 3 have a defined larger side surface and a smaller side surface thereof, with their larger side surfaces being disposed parallel to and at a distance from one another to form channels there between for conducting cooling liquid. The tube bundle comprises a first extreme tube 3*a* and a second extreme tube 3*b* respectively situated on both sides of the remaining tubes 3 of the tube bundle.

On one side at their open ends the tubes 3, 3*a*, 3*b* of the core 2 are gas-tightly connected with an inlet header 4 through which cooling gas is delivered from a hot gas inlet channel 20. On the other, opposite side thereof, at their open ends the tubes 3, 3*a*,3*b* are gas-tightly connected with an outlet header 5 from which cooled gas is discharged through a cool gas outlet channel 30.

The inlet header 4 and the outlet header 5 have tetragonal shaped flanges 4*a* and 5*a* defining corners 4*b* and 5*b*. At the corners 4*b*, 5*b* the header flanges 4*a* and 5*a*, have a profile surrounding the side surfaces of the extreme tubes 3*a*, 3*b*, after assembling the cooler 1. The construction of the gas tubes, headers, inlet and outlet connector gas channels are known.

On both sides of the tube bundle, between the extreme tubes 3*a*, 3*b* and between the headers 4, 5, there are situated side housing parts 6, 7 having longitudinal edges 6*a*,7*a* extending along the extreme tubes 3*a*,3*b* and connected with the extreme tubes 3*a*,3*b* in a liquid-tight way, and transverse edges 6*b*, 7*b* extending transversely to the tubes 3,3*a*,3*b* and connected in a liquid-tight way with the flanges 4*a*,5*a* of the headers 4,5. An inlet connector tube 8 and an outlet connector tube 9 are connected to the side housing parts 6,7 to conduct cooling liquid through the cooler 1 around the tubes 3,3*a*,3*b* in order to absorb heat from the gas flowing through the tubes 3,3*a*,3*b*.

After assembling the heat exchanger 1, the longitudinal edges 6*a*,7*a* of the side housing parts 6,7 are connected in a liquid-tight way with the extreme gas tubes 3*a*,3*b* along their lengths, and the transverse edges 6*b*,7*b* of the side housing parts 6,7 are connected in a liquid-tight way with the flanges 4*a*,5*a* of the headers 4,5.

The liquid-tight connections between the tube bundle and the longitudinal edges 6*a*,7*a* of the side housing parts 6,7 and the flanges 4*a*,5*a* of the headers 4,5 and the transverse edges 6*b*,7*b* of the side plates 6,7 are carried out by hard soldering.

In order to improve the liquid-tightness of connections in the header flange corners 4*b*, 5*b* after assembling the heat exchanger 1, at least one of the side housing parts 6,7 is provided with at least one protrusion 10 arranged in a corner thereof and projected from the at least one side housing part 6,7. In the embodiment illustrated in FIGS. 1-7 and described later on each of the side housing part 6,7 has four protrusions 10 projected at each of the corner thereof. The protrusion 10 extends from the longitudinal edges 6*a*,7*a* of the side housing part 6,7 and is bent to contact the side surface of the extreme tubes 3*a*,3*b* of the tube bundle.

Figure 2:
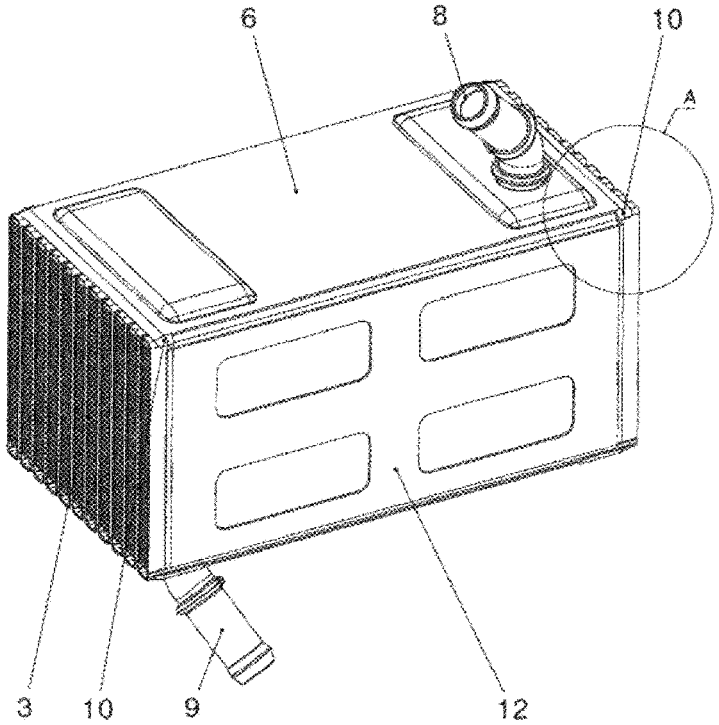
FIG. 2 shows an isometric view of the heat exchanger of FIG. 1 after partial assembly, before connecting with headers.

In the presented exemplary embodiment, best seen in FIG. 2, the edges of the tube bundle and, especially, edges between the larger and the smaller side surfaces of the extreme tubes 3*a*, 3*b* are rounded and the protrusions 10 are arched to form a shape matching the shape of those rounded edges and partially surrounding the extreme tubes 3*a*, 3*b*.

In alternative embodiment (not shown) side housing parts with their protrusions can be located above extreme tubes of the tube bundle and then the protrusions are extended transversally the stacked tube bundle and are bent in the direction transversal to the stacked tubes.

Figure 3:
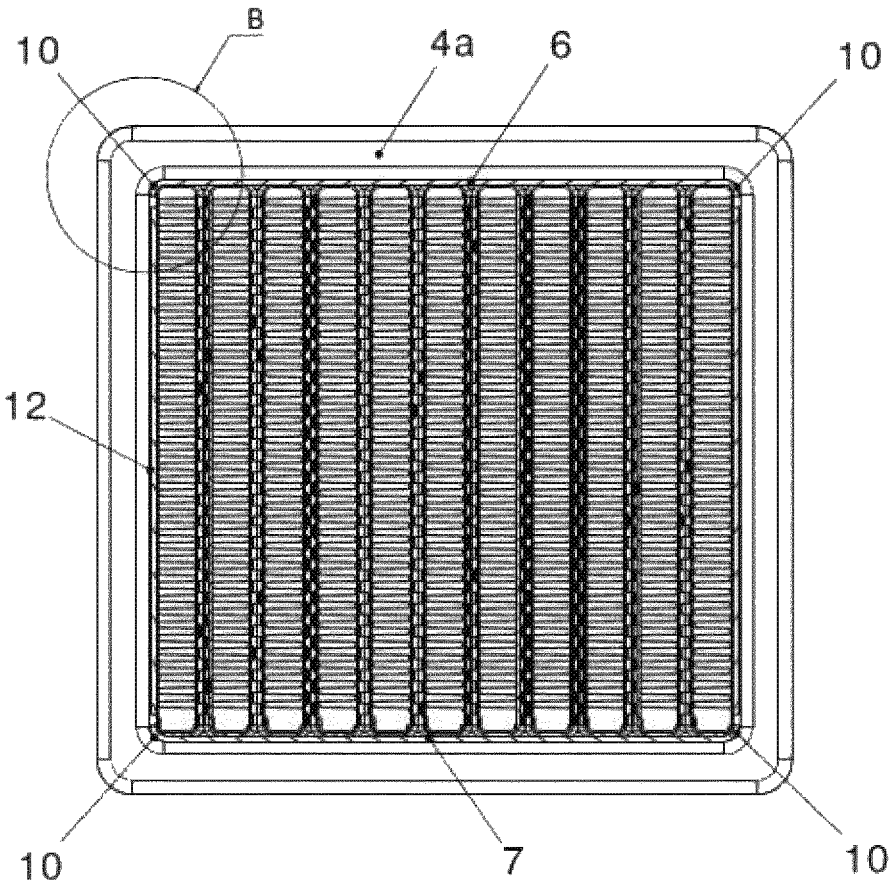
FIG. 3 shows a plan view from one header of the heat exchanger with cut-out of a part of the header, illustrating the connection between open ends of the tube bundle, header flange, side housing parts and side plates.
Figure 4:
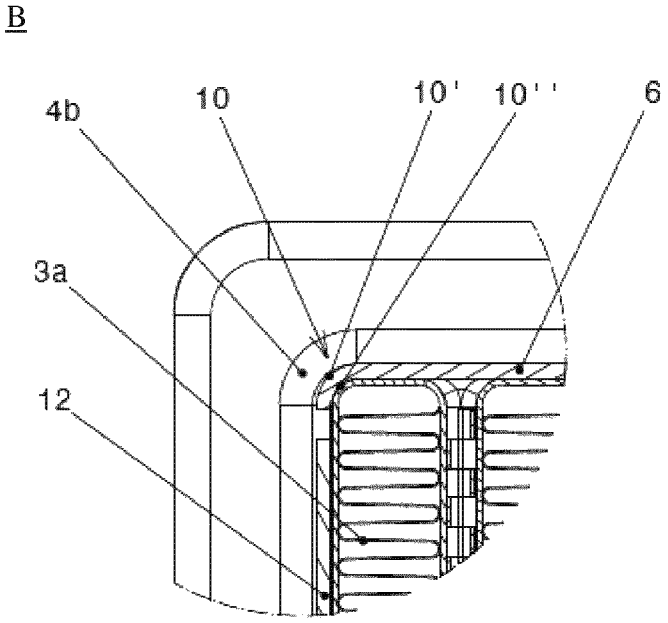
FIG. 4 shows an enlarged view of a detail "B" of FIG. 3.

In the illustrated embodiment, seen in FIGS. 3, 4, shape of the protrusion 10 looks like a plane wing having an external surface 10' which faces the corner 4*b*, 5*b* of the header flange 4*a*, 5*a* and is convex in the plane perpendicular to the longitudinal edges 6*a*,7*a* of the side housing parts 6,7 and the tube bundle. The protrusion 10 has an internal surface 10" which faces the tube bundle and is concave in the plane perpendicular to the longitudinal edges 6*a*,7*a* of the side housing parts 6,7 and the tube bundle. The terms "external" and "internal" are defined in relation to the tube bundle of the heat exchanger 1.

Figure 7:
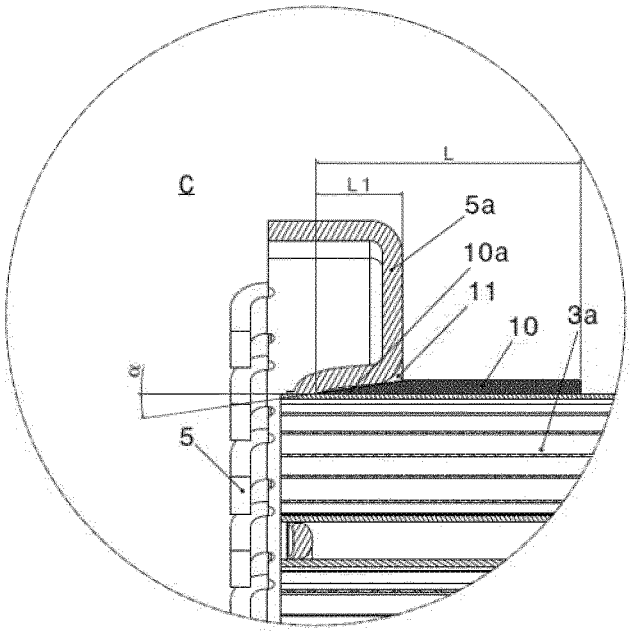
FIG. 7 shows an enlarged view of part "C" of FIG. 6, presenting a connection of a protrusion with the tube bundle and a header flange, after assembling the heat exchanger.

The external convex surface 10' of the protrusion 10 is formed into a shape completing the profile shape of the flange corner 4*b*,5*b* of the header 4,5. As a result, after assembling the heat exchanger 1, the external convex surface 10' of the protrusion 10 abuts the flange corner 4*b*,5*b* of the header 4,5 and ensures a liquid-tight connection therebetween (FIGS. 4, 7)

Figure 5:
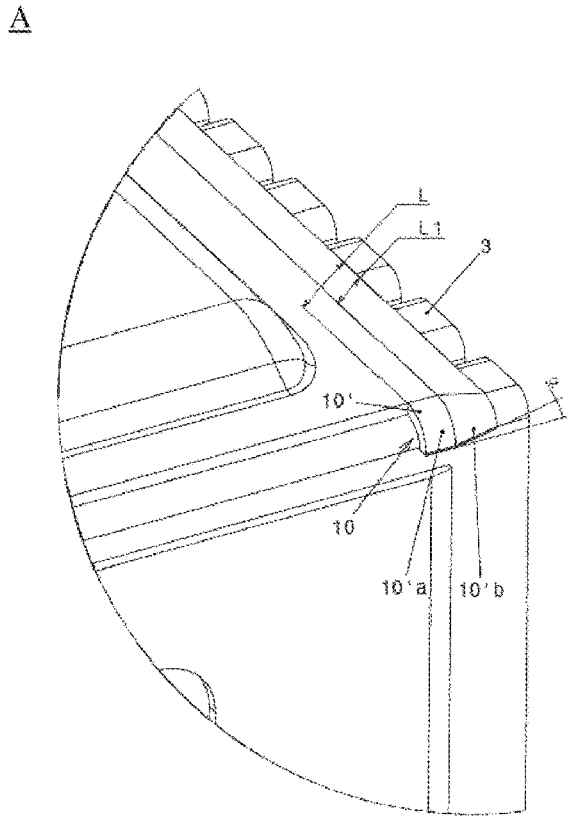
FIG. 5 shows an enlarged isometric view of the detail "A" of the heat exchanger of FIG. 2, presenting the protrusion connected to the extreme tube of the tube bundle of the heat exchanger.

In preferred embodiment, shown in FIG. 5, the external convex surface 10' of the protrusion 10 comprises a cylindrical section 10'*a* and tapered section 10'*b* declined outwardly to the header 4,5 to facilitate the penetration the protrusion 10 into the header corners 4*b*, 5*b*. The tapered section 10'*b* tapers with a convergence angle α from 2° to 45° in relation to the cylindrical section 10'*a* of the external convex protrusion surface 10'.

A length L of the protrusion 10 depends on the depth of the header flange 4*a*,5*b* at its corners 4*b*, 5*b*. Minimum length of the protrusion 10 is defined by the dimension that goes under the header flange 4*a*,5*b*. As a preference, maximum length of the protrusion 10 is 30 mm.

Preferably, the tapered section 10'*b* of the external convex surface 10' has a length L1 which is not larger than the depth of the area receiving the protrusion 10 in the header flange corner 4*b*,5*b*.

Figure 6:
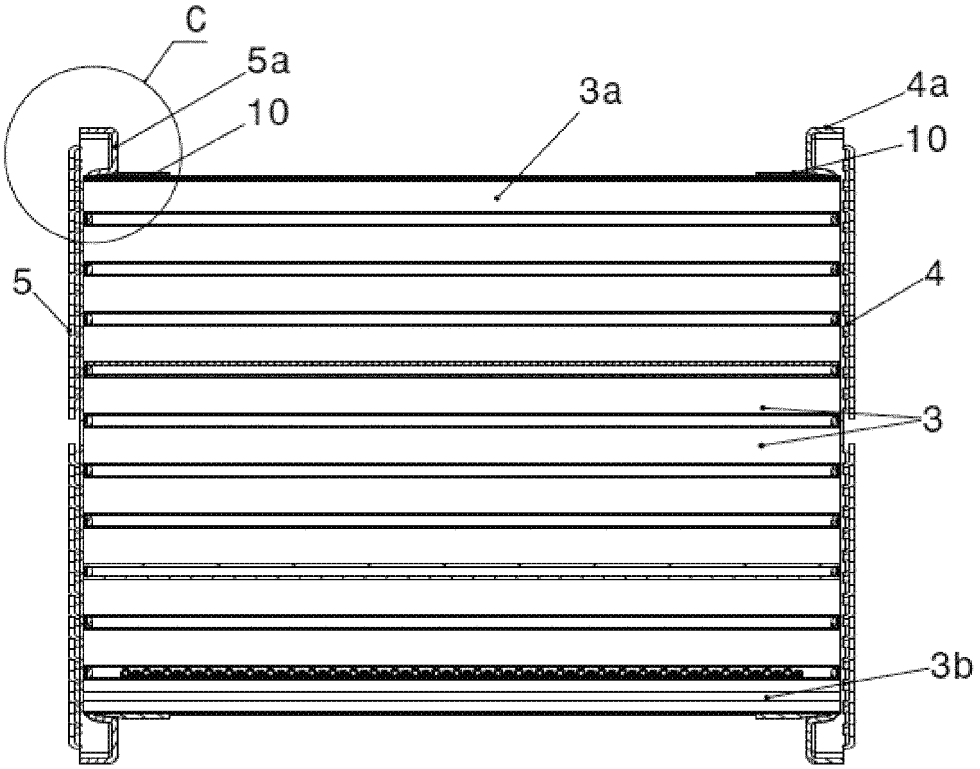
FIG. 6 shows a longitudinal section of the heat exchanger according to the invention, after assembling.

To facilitate the penetration of the protrusion into the header flange corner 4*b*,5*b* the header flange 4*a*,5*a*, is obliquely deflected_towards the protrusion 10 to form a cavity 11 convergent to the inside of the flange 4*a*,5*a* (FIG. 6, 7).

The protrusion 10, preferably with its tapered section 10'*b* of its external convex surface 10' is received in the cavity 11 to enable deep penetration of the protrusion 10 into the profile of the header flange 4*a*,5*a* at its corner 4*b*, 5*b*.

It is particularly desirable that the protrusions 10 of the side housing part 6,7 be shaped from a material that is more deformable that the material of header flanges 4*a*, 5*a*, which ensures that during the assembly, when the protrusions 10 are placed in the flange 4*a*, 5*a*, the protrusions 10 are deformed to exactly fit into the profile of the header flange 4*a*, 5*a*, which ensures a particularly advantageous sealing of the connection in the flange corners 4*b*, 5*b*.

Protrusions 10 may be formed as an integral part with the side housing parts 6, 7 of the cooler 1 in one process of extrusion, casting or cutting, e.g. laser cutting.

After the assembly of the heat exchanger 1, which includes placing the protrusions 10 of the side housing parts 6,7 in the corners 4*b*,5*b* of the headers 4,5, the connections of the heat exchanger 1 are hard soldered in a soldering furnace, to join together the extreme tubes 3*a*,3*b* with the longitudinal edges 6*a*,7*a* of the side housing parts 6, 7, and the header flanges 4*a*, 5*a* with the side plate transverse edges 6*b*,7*b* by means of hard solder.

In particular exemplary embodiments, after the core 2, the headers 4, 5 and the side housing parts 6, 7 have been assembled together, side plates 12 are attached, which are placed transversely to the side housing parts 6, 7 above the extreme gas tubes and are connected with the headers 4, 5.

The heat exchanger may by a charge air cooler used in motor vehicles to cool air supplied to combustion engines in order to increase the efficiency of those engines.

The invention claimed is:

1. A heat exchanger for motor vehicles, comprising:

a core comprising a tube bundle of open ended stacked tubes and comprising a top and a bottom extreme tubes;

a plurality of headers, each having a shaped flange with corners and being connected with open ends of the tubes; and side housing parts situated on opposite sides of the core and extending at least partly between the extreme top and bottom tubes and between one of the plurality of headers, wherein at least one of the side housing parts has at least one protrusion projecting from the side housing part in a corner thereof and bent to contact the side surface of the tube bundle, wherein the at least one protrusion has an external surface opposite to the tube bundle and formed into a shape matching the profile shape of the flange of the one of the plurality of headers in its corner, wherein the external surface of the at least one protrusion abuts the flange of the header to ensure a liquid-tight connection of the header with the flange at the corner thereof.

2. The heat exchanger according to claim 1, wherein the side housings parts have longitudinal edges extending along one of the top and bottom extreme tubes of the tube bundle and transversal edges extending transversally to the stacked tubes.

3. The heat exchanger according to claim 1, wherein the side housing parts with their protrusions are located above extreme tubes of the tube bundle and the protrusions are extended transversally the stacked tube bundle.

4. The heat exchanger according to claim 1, wherein the external surface of the protrusion is an external convex surface and the protrusion has an internal concave surface which faces and abuts the tube bundle.

5. The heat exchanger according to claim 4, wherein the external convex surface of the protrusion comprises a cylindrical section and tapered section declined outwardly to the header to facilitate the penetration the protrusion into the header flange corners.

6. The heat exchanger according to claim 4, wherein the tapered section tapers with a convergence angle from 2° to 45° in relation to the cylindrical section of the protrusion.

7. The heat exchanger according to claim 4, wherein the tapered section of the protrusion has a length which is not larger than the depth of the area of the header flange corner, which receives the protrusion.

8. The heat exchanger according to claim 1, wherein the header flange is obliquely deflected towards the protrusion to form a cavity convergent to the inside of the flange and the protrusion is received in the cavity.

9. The heat exchanger according to claim 1, wherein the edges of the tube bundle are rounded, and the at least one protrusion is arched to form a shape matching the shape of the side surfaces of the tube bundle and partially surround the tube bundle.

10. The heat exchanger according to claim 1, wherein the at least one protrusion is formed as an integral part with one of the side housing parts.

11. The heat exchanger according to claim 1, wherein the at least one protrusion is formed from a material that is more deformable than the flange of the header.

12. The heat exchanger according to claim 1, wherein the tube bundle and the side housing parts, and the header flange and the side housing parts are joined together by hard solder.

13. The heat exchanger according to claim 1, further comprising: a fluid channel connected to the header.

14. The heat exchanger according to claim 1, further comprising: side plates, which are placed transversely to the side housing parts above the extreme tubes and are connected with the header.

15. The heat exchanger according to claim 1, wherein the heat exchanger is a charge air cooler used in motor vehicles to cool air supplied to combustion engines.

16. A heat exchanger for motor vehicles, comprising:

a core comprising a tube bundle of open ended stacked tubes and comprising a top and a bottom extreme tubes;

an inlet header gas-tightly connected to one side of the open-ended tubes;

an outlet header gas-tightly connected to another side of the open-ended tubes, each of the inlet and outlet headers having a shaped flange with corners that are connected with open ends of the tubes; and side housing parts situated on both opposite sides of the tube bundle and extending at least partly between the extreme top and bottom tubes and between the inlet and outlet headers, wherein at least one of the side housing parts has at least one protrusion projecting from the side housing part in a corner thereof and bent to contact the side surface of the tube bundle, wherein edges of the tube bundle and edges between larger and smaller side surfaces of the extreme tubes are rounded, and wherein the at least one protrusion is arched to form a shape matching the rounded edges of the tube bundle, and wherein an external surface of the at least one protrusion abuts the flange of at least one of the inlet and outlet headers to ensure a liquid-tight connection of the at least one header with the flange at the corner thereof.

17. The heat exchanger of claim 16, wherein the at least one of the side housing parts has four protrusions, at each corner of the at least one side housing part.

* * * * *